US008882259B2

(12) United States Patent
Sasaki et al.

(10) Patent No.: US 8,882,259 B2
(45) Date of Patent: Nov. 11, 2014

(54) RECORDING APPARATUS

(75) Inventors: Tsuneyuki Sasaki, Matsumoto (JP); Yoichi Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 17 days.

(21) Appl. No.: 13/569,918

(22) Filed: Aug. 8, 2012

(65) Prior Publication Data

US 2013/0050370 A1 Feb. 28, 2013

(30) Foreign Application Priority Data

Aug. 22, 2011 (JP) ..... 2011-180191

(51) Int. Cl.
*B41J 11/00* (2006.01)

(52) U.S. Cl.
CPC ..... *B41J 11/002* (2013.01); *B41J 11/0015* (2013.01)
USPC ..... 347/102; 347/17; 347/34

(58) Field of Classification Search
CPC ..... B41J 11/002; B41J 11/0015; B41J 11/42; B41J 29/393; B41J 2/04563; B41J 2/0458; B41J 2/1714; B41J 2/20; B41J 2/2114
USPC ..... 347/102, 16, 17, 34, 101; 101/488; 219/216; 346/25
See application file for complete search history.

(56) References Cited

U.S. PATENT DOCUMENTS 4,751,528 A * 6/1988 Spehrley et al. ..... 347/18
5,021,805 A * 6/1991 Imaizumi et al. ..... 347/187
5,296,873 A 3/1994 Russell et al.
5,467,119 A * 11/1995 Richtsmeier et al. ..... 347/102
5,528,271 A 6/1996 Ebisawa
5,774,155 A * 6/1998 Medin et al. ..... 347/102
6,074,035 A 6/2000 Irizawa et al.
6,280,014 B1 * 8/2001 Sharma et al. ..... 347/28
6,340,225 B1 * 1/2002 Szlucha ..... 347/102
6,367,906 B1 * 4/2002 Hiramatsu et al. ..... 347/34
6,390,618 B1 * 5/2002 Wotton et al. ..... 347/102
6,463,674 B1 * 10/2002 Meyers et al. ..... 34/304
6,523,949 B1 * 2/2003 Ewert ..... 347/105
6,530,657 B2 * 3/2003 Polierer ..... 347/102
6,854,842 B2 * 2/2005 Martin et al. ..... 347/102
7,949,280 B2 * 5/2011 Arimoto et al. ..... 399/92
8,136,909 B2 * 3/2012 Ogasawara et al. ..... 347/18
8,459,790 B2 * 6/2013 Hara et al. ..... 347/104
2002/0109767 A1 * 8/2002 Polierer ..... 347/102
2003/0142187 A1 * 7/2003 Elgee et al. ..... 347/102

(Continued)

FOREIGN PATENT DOCUMENTS

JP 02-251453 10/1990
JP 07-017037 1/1995

(Continued)

*Primary Examiner* — Laura Martin
*Assistant Examiner* — Leonard S Liang
(74) *Attorney, Agent, or Firm* — Workman Nydegger

(57) ABSTRACT

A recording apparatus includes a support member that supports a recording medium, a heating device that heats the recording medium on the support member, a recording head that ejects fluid onto the recording medium on the support member and that is positioned between the support member and the heating device, a blower that has a blowing port from which gas is blown, and a carriage that moves and has the recording head mounted thereon. The carriage has an enclosing structure inside which at least part of the gas blown from the blowing port is taken and inside which a gas layer in which the gas flows is formed between the recording head and the heating device.

5 Claims, 4 Drawing Sheets

(56) References Cited

U.S. PATENT DOCUMENTS

| | | | | |
|---|---|---|---|---|
| 2003/0160852 | A1* | 8/2003 | Pickup | 347/102 |
| 2005/0046687 | A1* | 3/2005 | Silverbrook et al. | 347/104 |
| 2005/0253912 | A1* | 11/2005 | Smith et al. | 347/102 |
| 2009/0085997 | A1* | 4/2009 | Sakamoto | 347/102 |
| 2010/0149297 | A1* | 6/2010 | Kanada | 347/102 |
| 2011/0044735 | A1* | 2/2011 | Okuno et al. | 399/323 |

FOREIGN PATENT DOCUMENTS

| | | |
|---|---|---|
| JP | 08-276574 | 10/1996 |
| JP | 2005-059478 | 3/2005 |
| JP | 2006-175645 | 7/2006 |
| JP | 2006-224460 | 8/2006 |
| JP | 2008-229949 | 10/2008 |
| JP | 2008-279712 | 11/2008 |

* cited by examiner

RECORDING APPARATUS

This application claims priority to Japanese Patent Application No. 2011-180191 filed on Aug. 22, 2011. The entire disclosure of Japanese Patent Application No. 2011-180191 is hereby incorporated herein by reference.

BACKGROUND

1. Technical Field

The present invention relates to a recording apparatus.

2. Related Art

An ink jet printer is a known example of a recording apparatus that records images, characters, or the like by ejecting fluid onto recording media. In this ink jet printer, when, for example, water-based pigment ink (fluid) that needs drying by evaporation is used, a heating device needs to be provided in order to dry the ink ejected onto a recording medium.

JP-A-2006-224460 discloses an exemplary apparatus of related art. In the apparatus, a halogen heater radiatively heats a region of a recording medium in which recording has been performed by an ink jet head, so that ink deposited onto the recording medium is promptly dried so as to suppress aggregation, spreading or the like of the ink, thereby allowing a high-quality print to be provided. An infrared heater, such as the halogen heater, has the following advantages. The method using an infrared heater exhibits thermal responsiveness that is superior to that used in the case of heating the recording medium from the rear surface side thereof by using heat conduction. The infrared heater can be used regardless of the thickness of the recording medium because it directly, radiatively heats the recording surface of the recording medium. In addition, the infrared heater exhibits a property of energy thereof easily penetrating a coating formed by ink drying.

In the known technique, the ink jet head is disposed between a platen which supports the recording medium and the infrared heater which is the heating device that heats the recording medium supported on the platen, and ink is ejected onto the recording medium on the platen. One of the reasons for the arrangement is that it is more preferable to have a smaller distance between the infrared heater and an object to be heated, in view of energy efficiency.

In an ink system including the ink jet head, temperature control is necessary such that ink can circulate without becoming viscous and solid. However, when the ink jet head is disposed between the platen and the heating device, the ink jet head is heated, and there may be such a high temperature gradient that the temperature control does not work. The occurrence of a high temperature gradient also increases the gradient of the ink viscosity, thereby causing ink ejection failure.

SUMMARY

An advantage of an aspect of the invention is that it provides a recording apparatus that allows the temperature of fluid to be controlled by blocking the effect of heating by a heating device.

According to an aspect of the invention, a recording apparatus has a support member that supports a recording medium, a heating device that heats the recording medium on the support member, a recording head that ejects fluid onto the recording medium on the support member and that is positioned between the support member and the heating device, a blower that has a blowing port from which gas is blown, and a carriage that moves and has the recording head mounted thereon and an enclosing structure inside which at least part of the gas blown from the blowing port is taken and inside which a gas layer in which the gas flows is formed between the recording head and the heating device.

According to such a structure, when the carriage passes the blowing port of the blower that blows gas toward the recording medium, the gas is taken inside an enclosing structure of the carriage and flows between the recording head and the heating device so as to form the gas layer. In the gas layer, because of the flow of the gas, heat does not accumulate and heat conduction is suppressed, so that the effect of heating by the heating device may be blocked on a near side of the recording head.

According to the aspect of the invention, it is preferable that the carriage have an intake port that opens opposite the blowing port.

According to such a structure, because the blowing port and the intake port are disposed opposite each other, gas is directly taken in with a predetermined blast pressure maintained, so that a satisfactory flow of the gas is formed in the gas layer.

According to the aspect of the invention, the recording apparatus may further include a transport device that transports the recording medium. It is preferable that the carriage have an exhaust port that opens downstream in a transport direction of the recording medium.

According to such a structure, because the gas having flowed inside the enclosing structure of the carriage is discharged downstream in the transport direction, a printing region might not be affected by the flow of the gas discharged from the exhaust port.

According to the aspect of the invention, it is preferable that the blowing port be provided along a movement path of the carriage.

According to such a structure, even when the carriage is moved to another position, gas is directly taken inside the enclosing structure of the carriage from the blowing port, so that the gas layer may be formed between the recording head and the heating device.

According to the aspect of the invention, it is preferable that the heating device have a heat generating section that is provided along the movement path of the carriage, and, in the movement path of the carriage, the portion covered by the blowing port is larger than the portion covered by the heat generating section.

According to such a structure, in the movement path of the carriage, when the carriage is located within the portion of the blowing port and outside the portion of the heat generating section, the carriage is efficiently cooled by the gas being blown from the blowing port without being subjected to heat from the heat generating section.

According to the aspect of the invention, it is preferable that the enclosing structure of the carriage have a heat sink plate that has one surface facing the heating device and the other surface facing the gas layer.

According to such a structure, even when the one surface is heated by the heating device, the heat sink plate with high heat dissipation characteristics may efficiently dissipate the heat received thereby by the flow of the gas in the gas layer on the other surface side, the wind generated by the movement of the carriage, and the like.

BRIEF DESCRIPTION OF THE DRAWINGS

The invention will be described with reference to the accompanying drawings, wherein like numbers reference like elements.

DESCRIPTION OF EXEMPLARY EMBODIMENT

Figure 1:
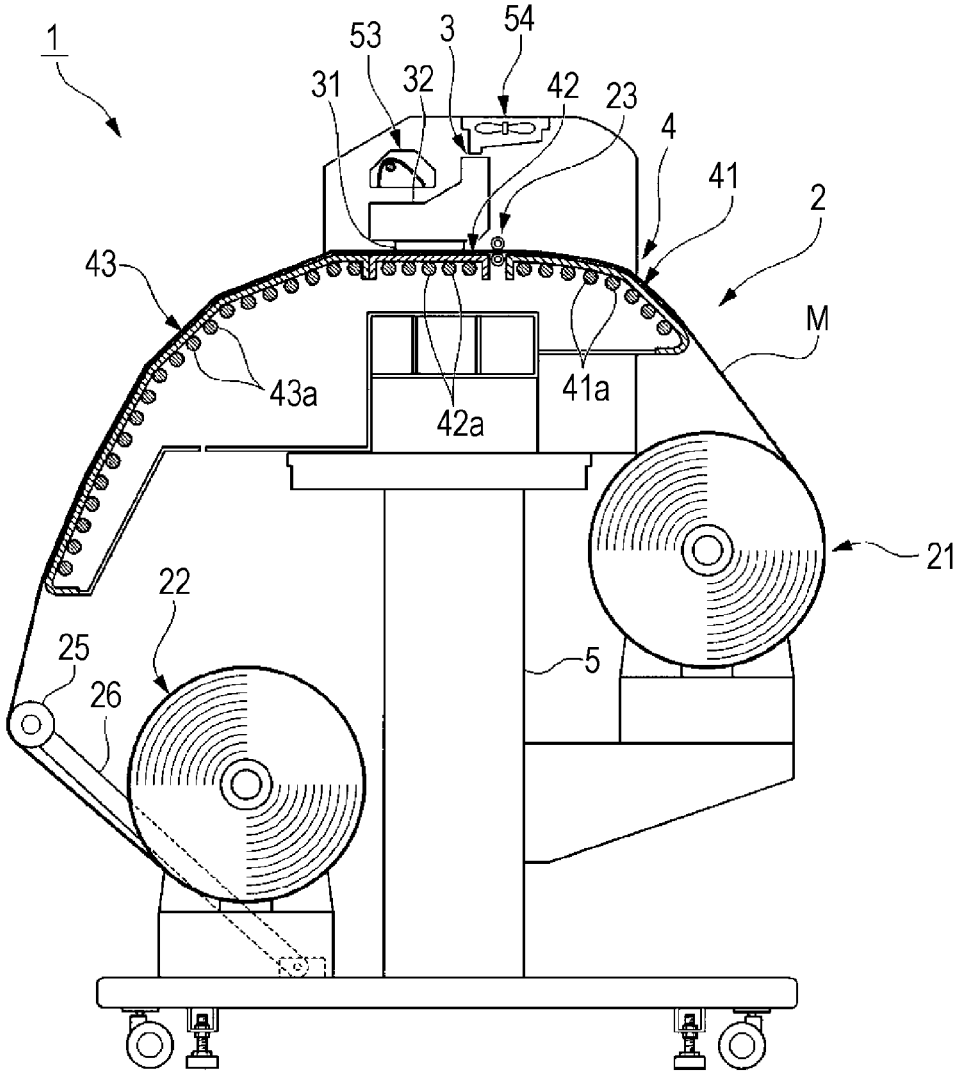
FIG. 1 is a configuration diagram illustrating a printer in an embodiment of the invention.

An embodiment of a recording apparatus according to the invention will be described below with reference to the accompanying drawings. In the drawings used for the following description, the members are not drawn to scale so that the members are of recognizable size. In the embodiment, an ink jet printer (hereinafter referred to as printer) is exemplified as the recording apparatus according to the invention.

FIG. 1 is a configuration diagram illustrating a printer 1 in the embodiment of the invention.

The printer 1 is a large format printer (LFP) that handles a relatively large medium (recording medium) M. The medium M of the embodiment is made of, for example, a vinyl chloride film.

As illustrated in FIG. 1, the printer 1 has a transport section (transport device) 2 that transports the medium M by a roll-to-roll method, a recording section 3 that records images, characters, or the like by ejecting ink (fluid) onto the medium M, and a heating section 4 that heats the medium M. These components are supported by a main body frame 5.

The transport section 2 has a roll 21 that transports the roll medium M and a roll 22 that rolls up the transported medium M. The transport section 2 has a transport roller pair 23 that transports the medium M in a transport path between the rolls 21 and 22. In addition, the transport section 2 has a tension roller 25 that applies tension to the medium M. The tension roller 25 is supported by a swing frame 26.

The recording section 3 has an ink jet head (recording head) 31 that ejects ink onto the medium M to be transported and a carriage 32 that has the ink jet head 31 mounted thereon and that is capable of reciprocating in a width direction (direction perpendicular to the plane of the paper in FIG. 1). The ink jet head 31 has a plurality of nozzles and is capable of ejecting ink that needs drying by osmosis or evaporation to be selected in accordance with the medium M. The ink jet head 31 in the embodiment is capable of ejecting water-based pigment ink that needs drying by evaporation.

The heating section 4 promptly dries and fixes ink on the medium M by heating the medium M, thereby preventing spreading or blurring of the ink so as to improve image quality.

The heating section 4 has a pre-heater section 41 that preheats the medium M on an upstream side of a transport direction relative to the position at which the recording section 3 is provided, a platen heater section 42 that heats the medium M at the position facing the recording section 3, and an after-heater section 43 that heats the medium M on a downstream side of the transport direction relative to the position at which the recording section 3 is provided.

In the embodiment, heating temperatures of heaters 41*a* in the pre-heater section 41 are set to 40° C., heating temperatures of heaters 42*a* in the platen heater section 42 are set to 40° C. (target temperature) as well as those of the heaters 41*a*, and heating temperatures of heaters 43*a* in the after-heater section 43 are set to 50° C., which is higher than those of the heaters 41*a* and 42*a*.

The pre-heater section 41 gradually raises the temperature of the medium M from a normal temperature to the target temperature (temperature in the platen heater section 42), thereby promoting prompt drying from the time of ink deposition.

The platen heater section 42 maintains the target temperature while the medium M is being subjected to ink deposition, thereby promoting prompt drying from the time of ink deposition.

The after-heater section 43 raises the temperature of the medium M to a higher temperature than the target temperature, and promptly dries ink, which still remains to be dried, of the ink deposited onto the medium M so as to completely dry and fix the deposited ink on the medium M at least before the roll 22 rolls up the medium M.

Next, a typical configuration of the carriage 32 and the platen heater section 42 of the embodiment will be described.

Figure 2:
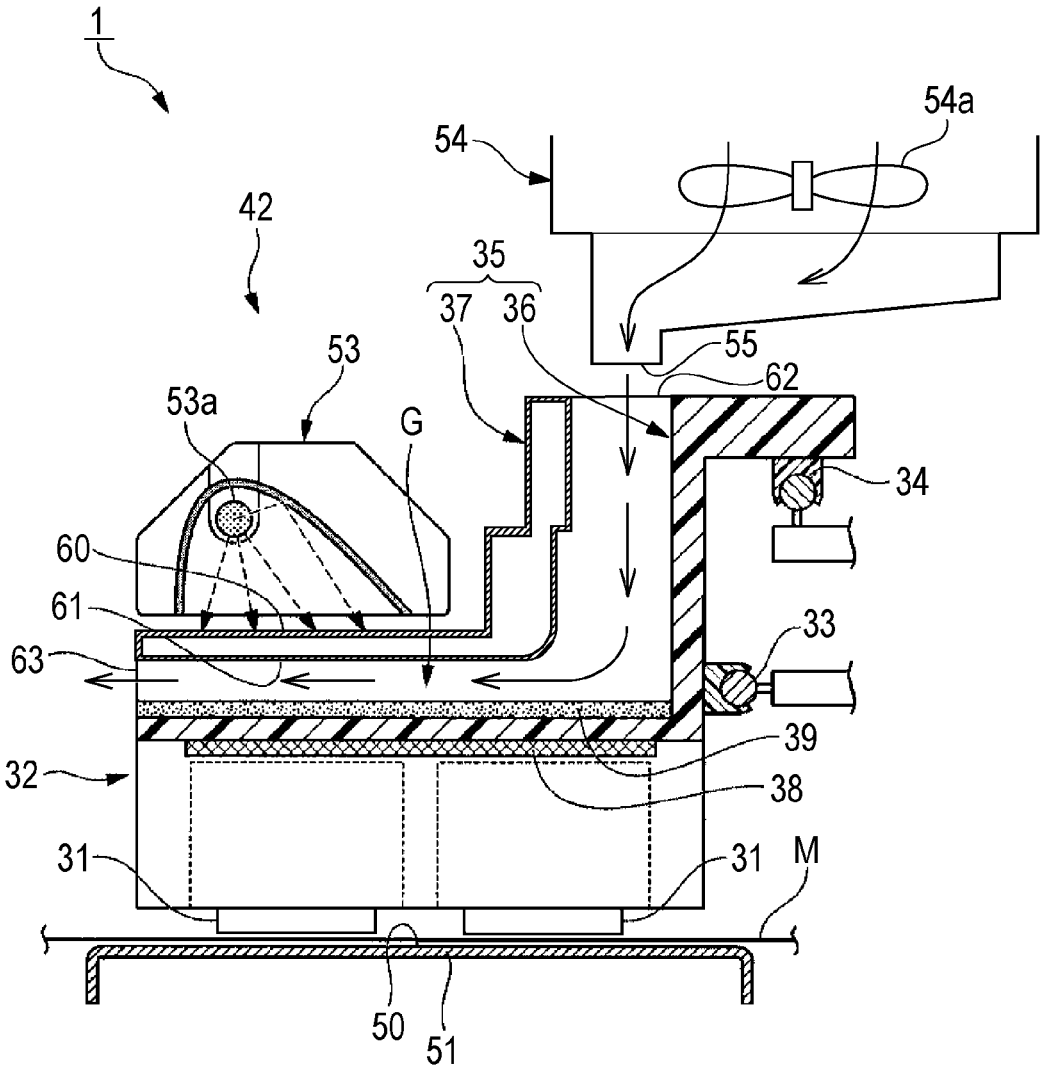
FIG. 2 is a configuration diagram illustrating a carriage and a platen heater section in the embodiment of the invention.
Figure 3:
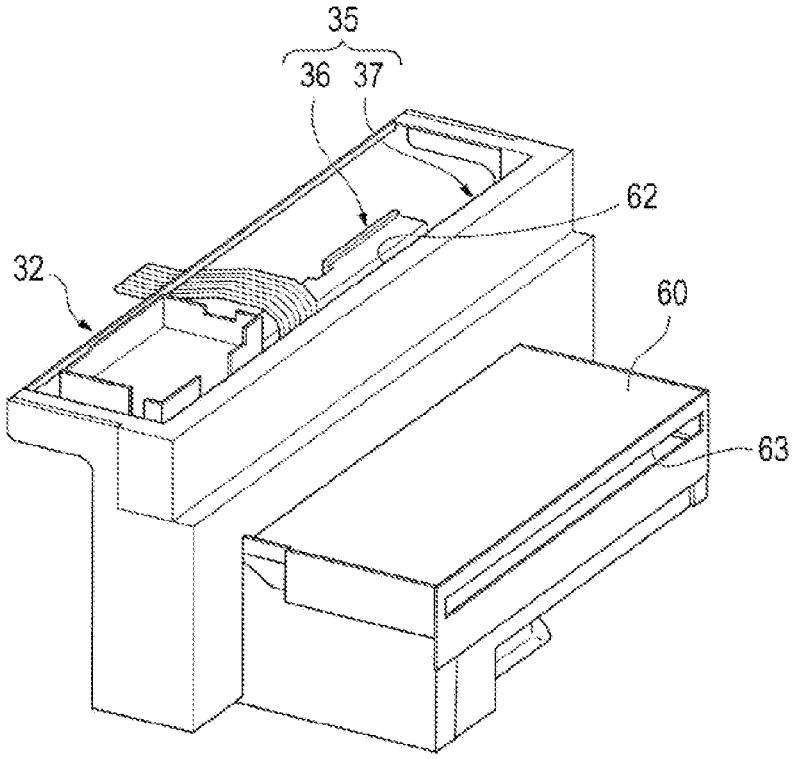
FIG. 3 is a perspective view illustrating the carriage in the embodiment of the invention.
Figure 4:
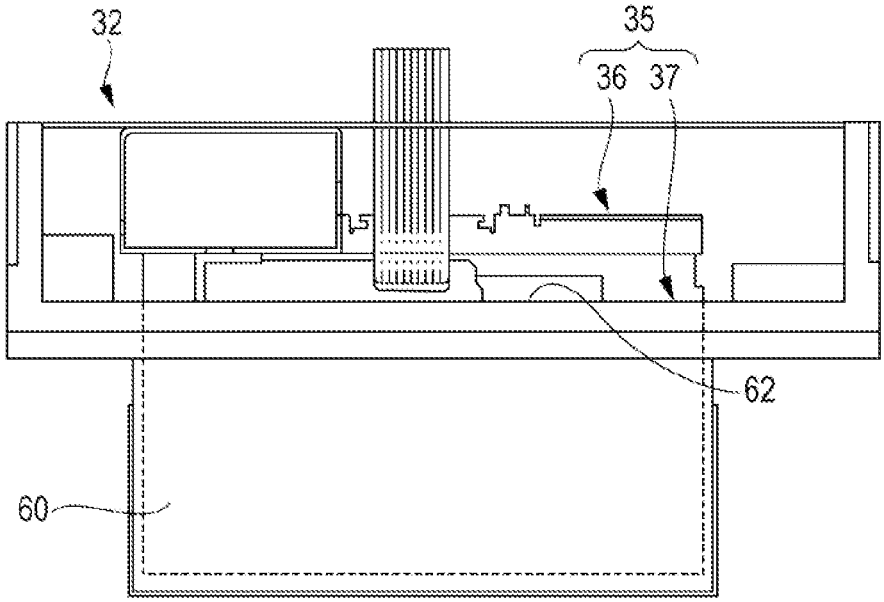
FIG. 4 is a plan view illustrating the carriage in the embodiment of the invention.
Figure 5:
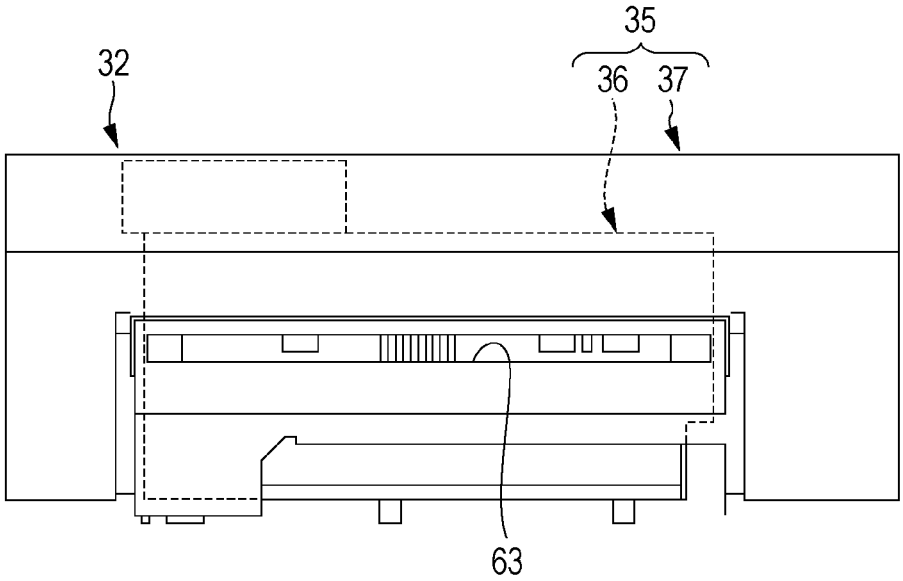
FIG. 5 is a front view illustrating the carriage in the embodiment of the invention.

FIG. 2 is a configuration diagram illustrating the carriage 32 and the platen heater section 42 in the embodiment of the invention. FIGS. 3 to 5 are a perspective view, a plan view, and a front view, respectively, all illustrating the carriage 32 in the embodiment of the invention.

As illustrated in FIG. 2, the platen heater section 42 has a support member 51 (platen) having a support surface 50 that supports the medium M. The support member 51 is made of metal, has a flat shape, and is provided so as to extend in the width direction (direction perpendicular to the plane of the paper in FIG. 2) that is perpendicular to the transport direction of the medium M (right-and-left direction in the plane of the paper in FIG. 2). The support member 51 has a greater width than the maximum width of the medium M that can be transported by the transport section 2 so as to support the medium M across the width direction.

An infrared heater (heating device) 53 is provided at the position facing the support surface 50 of the support member 51. The infrared heater 53 is provided so as to be held a predetermined distance away from the support surface 50 and to extend across a width direction of the support member 51. Accordingly, the infrared heater 53 radiatively heats the support member 51 by directly irradiating the support surface 50 with infrared energy, and directly, radiatively heats the recording surface of the medium M when the medium M is supported on the support surface 50.

The infrared heater 53 emits an electromagnetic wave with wavelengths in which the range from 2 μm to 4 μm is included in a main portion of the peak in a radiant spectrum. Hence, the infrared heater 53 does not excessively raise the temperature of ambient component members containing no water molecules and vibrates water molecules contained in ink, so that the frictional heat thereof may promote prompt drying. Accordingly, much of the infrared energy is absorbed by the ink, so that the ink deposited onto the recording surface may be intensively heated.

The platen heater section 42 has a blower 54 having a blowing port 55 from which gas (air in the embodiment) is blown toward the medium M on the support member 51. The blower 54 has fans 54*a* therein and blows gas taken in from the outside at a predetermined blast pressure from the blowing port 55. The blowing port 55 is located above the carriage 32 and opens opposite the support surface 50. The blowing port 55 is provided on the upstream side of the transport direction relative to the infrared heater 53.

Across the width direction of the support member 51, the blowing port 55 is provided so as to extend or alternatively, the blowing ports 55 are provided so as to be interspersed. In order to secure the blast pressure from the blowing port 55 provided across the width direction, the multiple fans 54*a* are similarly provided so as to be interspersed at predetermined intervals across the width direction.

The blower 54 structured as described above has a function of improving heat transference in radiant heating by the infrared heater 53. That is, the blower 54 removes and diffuses a component evaporated from ink by radiant heating via the flow of the gas from the blowing port 55, so that the transfer efficiency of the infrared energy to the recording surface may be improved.

The ink jet head 31 is mounted in the carriage 32 and the carriage 32 moves along guides 33 and 34 in the width direction. The ink jet head 31 is held between the support member 51 and the infrared heater 53 by the carriage 32, and ejects ink toward the medium M on the support member 51. That is, in view of energy efficiency, the smaller the distance between the infrared heater 53 and the medium M, which is an object to be dried, the better. Thus, the infrared heater 53 is disposed in the vicinity of the carriage 32 that has the ink jet head 31 for ejecting ink mounted thereon. The carriage 32 has an enclosing structure 35 inside which at least part of the gas blown from the blowing port 55 is taken.

Inside the enclosing structure 35 of the carriage 32, a gas layer G in which the gas taken in flows is formed between the ink jet head 31 and the infrared heater 53. The enclosing structure 35 has a holder 36 made of resin and a heat sink plate 37 made of metal, and is formed by combining them. The holder 36 holds an ink system including the ink jet head 31.

A reference numeral 38 in FIG. 2 designates a schematically illustrated temperature control device that constitutes the ink system. The temperature control device 38 controls the temperature of ink. The temperature control device 38 is composed of, for example, a film heater when ink needs to be held at high temperature, for example, a Peltier element when ink needs to be cooled, or, for example, a heat storage sheet using latent heat of fusion when ink needs to be isothermally held.

A heat insulating member 39 is laid on an upper surface of the holder 36. The heat insulating member 39 is disposed between the ink jet head 31 and the gas layer G. As the heat insulating member 39, for example, a fibrous heat insulating member or a foamed heat insulating member may be employed.

An ink buffer, which is not illustrated, is disposed between the temperature control device 38 and the heat insulating member 39. Ink in the non-illustrated ink buffer is heated, cooled, isothermally held, etc. by the temperature control device 38, so that the temperature of the overall ink system is controlled.

The heat sink plate 37 has one surface 60 facing the infrared heater 53 and the other surface 61 facing the gas layer G. The heat sink plate 37 is composed of aluminum sheet metal with high heat dissipation characteristics, is formed so as to be substantially box shaped by sheet-metal working, and is mounted to cover the holder 36 (see FIGS. 3 to 5). As illustrated in FIG. 2, the heat sink plate 37 forms a space that defines the gas layer G above the ink jet head 31 together with the holder 36.

The heat sink plate 37 in the embodiment is formed by combining multiple pieces of aluminum sheet metal (see FIG. 3, etc.). Thus, as illustrated in FIG. 2, a hollow space may be defined between the one surface 60 and the other surface 61 of the heat sink plate 37. The one surface 60, which faces the infrared heater 53, of the heat sink plate 37 is preferably polished to a mirror finish. This allows at least part of infrared rays emitted toward the one surface 60 of the heat sink plate 37 to be reflected, thereby reducing infrared energy absorbed by the heat sink plate 37.

The carriage 32 has an intake port 62 that communicates with the gas layer G, and that opens opposite the blowing port 55. The intake port 62 is disposed at a position corresponding to the blowing port 55 and takes the gas blown from the blowing port 55 into the enclosing structure 35, above the infrared heater 53. As illustrated in FIGS. 3 and 4, the intake port 62 is provided at the top of the carriage 32 so as to form an opening in the carriage 32. The intake port 62 of the embodiment is defined by a gap between the holder 36 and the heat sink plate 37.

The carriage 32 has an exhaust port 63 that communicates with the gas layer G, and that opens downstream in the transport direction of the medium M (leftward in the plane of the paper in FIG. 2). The exhaust port 63 opens out in a side of the enclosing structure 35 that is substantially box shaped and the side faces downstream in the transport direction. The exhaust port 63 discharges the gas, which has been taken from the intake port 62 and has flowed between the ink jet head 31 and the infrared heater 53 as the gas layer G, outside the enclosing structure 35. The exhaust port 63 of the embodiment is defined by a rectangular opening formed in the heat sink plate 37 (see FIGS. 3 and 5).

Figure 6:
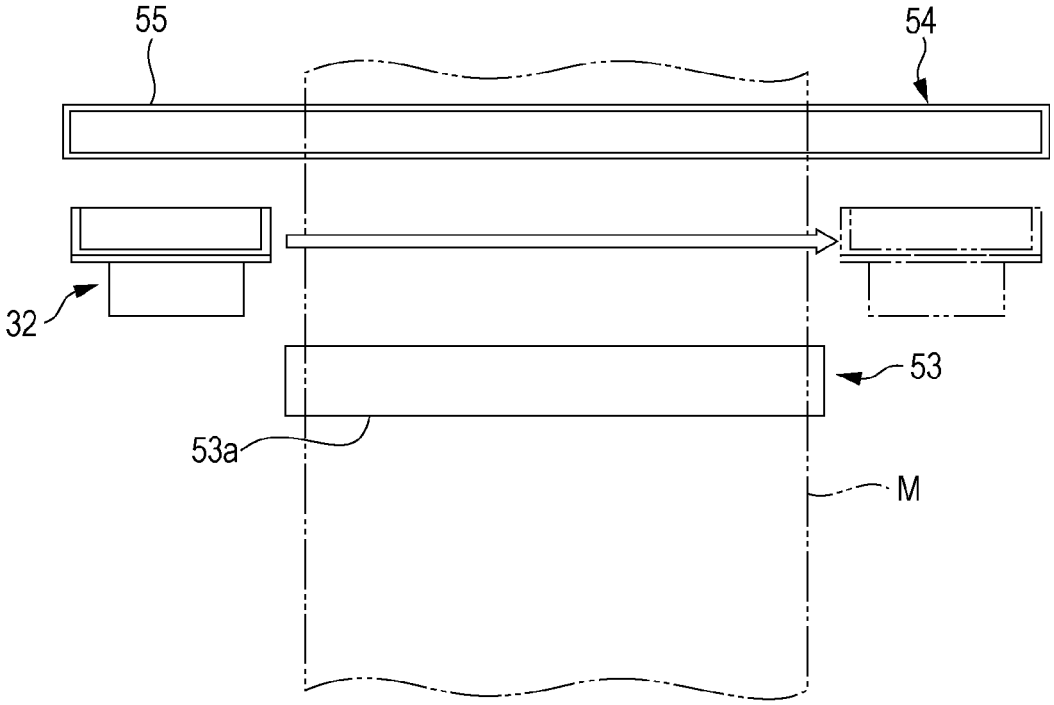
FIG. 6 illustrates, in a movement path of the carriage in the embodiment of the invention, portions covered by a blowing port and a heat generating section of an infrared heater.

FIG. 6 illustrates, in a movement path of the carriage 32 in the embodiment of the invention, portions covered by the blowing port 55 and a heat generating section 53*a* of the infrared heater 53. In FIG. 6, the carriage 32, the blowing port 55, and the infrared heater 53 are displaced from one another in the plane of the figure in order to increase visual identification thereof.

The blowing port 55 is provided along the movement path of the carriage 32 extending in the width direction. The heat generating section 53*a* of the infrared heater 53 is also provided along the movement path of the carriage 32.

In the infrared heater 53, the heat generating section 53*a* is a region in which a heat source for emitting infrared rays is provided. More specifically, the heat generating section 53*a* is the region of the heat source in which, for example, a coiled nichrome wire is provided in a quartz glass pipe. There are not included terminal areas connected to the nichrome wire at both ends of the region. In the movement path of the carriage 32, the portion covered by the heat generating section 53*a* is larger than the width of the medium M. Hence, an infrared irradiation region including both ends of the medium M in the width direction may be set, so that the infrared heater 53 may uniformly heat the recording surface of the medium M.

In the movement path of the carriage 32, the portion covered by the blowing port 55 is larger than the portion covered by the heat generating section 53*a*. More specifically, in the movement path of the carriage 32, the portion covered by the blowing port 55 is larger than the portion covered by the heat generating section 53*a* by at least a length of the carriage 32 (by two length of the carriage 32 in this embodiment). According to this structure, in the movement path of the carriage 32, when the carriage 32 is located within the portion of the blowing port 55 and outside the portion of the heat generating section 53*a*, the carriage 32 may be efficiently cooled by the gas being blown from the blowing port 55 without being subjected to heat from the heat generating section 53*a*.

Next, a printing operation performed by and action produced by the printer 1 having the structure described above will be described.

When the medium M is transported and reaches a printing region on the support surface 50, the ink jet head 31 starts printing. As illustrated in FIG. 2, the ink jet head 31 is mounted in the carriage 32 and performs printing, while reciprocating in the width direction. The infrared heater 53 emits infrared rays toward a predetermined infrared irradiation region set on the support surface 50.

The region of printing performed by the ink jet head 31 is included in the infrared irradiation region. Hence, when the carriage 32 moves away from the region of the recording surface on which ink has been deposited, the region is directly, radiatively heated by an electromagnetic wave with wavelengths in which the range from 2 μm to 4 μm is included in a main portion of the peak in a radiant spectrum. Thus, water molecules contained in the deposited ink are vibrated, and the frictional heat thereof promotes evaporation and drying. As a result, the ink is fixed on the medium M so that spreading or the like of the ink is not caused.

The blower 54 blows gas toward the recording surface of the medium M on the support member 51. A component, such as water vapor, evaporated from the ink by radiant heating of the infrared heater 53 is removed and diffuses from the recording surface via the gas being blown. Hence, infrared energy is absorbed by the recording surface without being blocked by the evaporated component so as to improve heat transference in radiant heating by the infrared heater 53, so that evaporation and drying of the ink may be promoted.

The ink jet head 31 ejects ink onto the medium M on the support member 51 between the support member 51 and the infrared heater 53, and thus measures against the heat produced by the infrared heater 53 need to be taken. In the embodiment, when the carriage 32 passes below the blowing port 55 of the blower 54 that blows gas toward the medium M, the gas is taken inside the enclosing structure 35 of the carriage 32 and flows between the ink jet head 31 and the infrared heater 53 so as to form the gas layer G.

In the gas layer G, because of the flow of the gas, heat does not accumulate and heat conduction is suppressed, so that the effect of heating by the infrared heater 53 may be blocked on a near side of the ink jet head 31. That is, the gas taken inside the enclosing structure 35 from the intake port 62 that opens opposite the blowing port 55 flows between the ink jet head 31 and the infrared heater 53 inside the enclosing structure 35. During that time, the gas having received heat from the other surface 61 and so forth of the heat sink plate 37, which has been being irradiated with infrared rays, is discharged from the exhaust port 63 outside the enclosing structure 35.

Hence, the gas layer G functions as a kind of heat insulating layer and thus may block the effect of heating by the infrared heater 53, thereby allowing a temperature gradient in the ink jet head 31 to be suppressed to such a temperature gradient that temperature control can be performed by the temperature control device 38. If the temperature of ink can be controlled by the temperature control device 38, the ink does not become viscous, solid, etc. in the ink jet head 31, so that a proper printing operation may be performed while maintaining predetermined ejection characteristics.

Because the carriage 32 of the embodiment has the intake port 62 that opens opposite and in proximity to the blowing port 55, gas is directly taken inside the enclosing structure 35 with a predetermined blast pressure maintained, so that a satisfactory flow of the gas is formed in the gas layer G. Hence, the flow of the gas is promoted without the gas accumulating, so that the heat insulating performance of the gas layer G may be improved.

Because the carriage 32 of the embodiment has the exhaust port 63 that opens downstream in the transport direction of the medium M, the gas having flowed inside the enclosing structure 35 of the carriage 32 is discharged downstream in the transport direction, so that the printing region might not be affected by the flow of the gas discharged from the exhaust port 63.

As illustrated in FIG. 6, because the blowing port 55 is provided along the movement path of the carriage 32, even when the carriage 32 is moved, gas is directly taken inside the enclosing structure 35 of the carriage 32 from the blowing port 55, so that the gas layer G may be formed. In addition, in the movement path of the carriage 32, because the portion covered by the blowing port 55 is larger than the portion covered by the heat generating section 53*a*, when the carriage 32 is subjected to heat from the heat generating section 53*a*, the gas layer G may be continuously formed inside the enclosing structure 35 of the carriage 32.

In the movement path of the carriage 32, when the carriage 32 is located in the region (e.g., carriage return area) within the portion of the blowing port 55 and outside the portion of the heat generating section 53*a*, the carriage 32 is efficiently cooled by the gas being blown from the blowing port 55 without being subjected to heat from the heat generating section 53*a*. Hence, for example, when a long, continuous printing operation is performed, operation control may be performed such that the carriage 32 is kept in the carriage return area every predetermined period of time and a cooling time for dissipation of the infrared energy absorbed thereby is set.

The enclosing structure 35 of the carriage 32 of the embodiment has the heat sink plate 37 that has the one surface 60 facing the infrared heater 53 and the other surface 61 facing the gas layer G. Thus, even when the one surface 60 is heated by the infrared heater 53, because the heat sink plate 37 has high heat dissipation characteristics, the heat sink plate 37 may efficiently dissipate the heat received thereby by the wind generated by the movement of the carriage 32. The one surface 60 is polished to a mirror finish, thereby allowing absorption of the infrared energy to be suppressed. Even when part of the heat received on the one surface 60 is conducted to the other surface 61, because the other surface 61 faces the gas layer G, the heat received thereby may be efficiently discharged outside the enclosing structure 35 via the flow of the gas in the gas layer G.

In the embodiment, because the heat insulating member 39 is disposed between the ink jet head 31 and the gas layer G, the effect of heating by the infrared heater 53 may be blocked on a near side of the ink jet head 31 more securely.

According to the above-mentioned embodiment, the printer 1 has the support member 51 that supports the medium M, the infrared heater 53 that heats the medium M on the support member 51, and the ink jet head 31 that ejects ink onto the medium M on the support member 51 between the support member 51 and the infrared heater 53. The printer 1 includes the blower 54 that has the blowing port 55 from which gas is blown toward the medium M on the support member 51 and the carriage 32 that has the ink jet head 31 mounted thereon and that moves. The carriage 32 has the enclosing structure 35 inside which at least part of the gas blown from the blowing port 55 is taken and inside which the gas layer G in which the gas flows is formed between the ink jet head 31 and the infrared heater 53. According to such a structure, when the carriage 32 passes the blowing port 55 of the blower 54 that blows gas toward the medium M, the gas is taken inside the enclosing structure 35 of the carriage 32 and flows between the ink jet head 31 and the infrared heater 53 so as to form the gas layer G. In the gas layer G, because of the flow of the gas, heat does not accumulate and heat conduction is suppressed, so that the effect of heating by the infrared heater 53 may be blocked on a near side of the ink jet head 31.

Thus, the embodiment provides the printer 1 that allows the temperature of ink to be controlled by blocking the effect of heating by the infrared heater 53. This also allows for temperature control of the ink system inside the carriage 32, which is a reciprocating mechanism, without a significant mechanism change in a heating process.

The preferred embodiment of the invention is described with reference to the drawings; however, the aspect of the invention is not limited to the embodiment. Shapes, combinations and so forth of the component members described in the foregoing embodiment are just examples, and various modifications can be made on the basis of design requirements or the like without departing from the gist of the aspect of the invention.

For example, in the embodiment, the infrared heater 53 is taken as an example of the heating device. However, the heating device is not limited to the infrared heater and may be a device or the like that performs heating using hot air.

For example, in the embodiment, air is taken as an example of the gas blown from the blowing port 55. However, the gas is not limited to air and may be gas whose components are adjusted, cooling gas which is cooled, or the like.

For example, in the embodiment, the printer 1 is taken as an example of the recording apparatus. However, the recording apparatus is not limited to the printer and may be an apparatus, such as a copying machine or facsimile machine.

In addition, as the recording apparatus, a recording apparatus that ejects or discharges fluid other than ink may be employed. An embodiment of the invention may be applied to various types of recording apparatuses having, for example, recording heads which eject a very small amount of liquid droplets. Here, the term "liquid droplet" refers to the state of liquid ejected from the recording apparatus, and examples of the liquid droplet include a grain-shaped liquid, a tear-shaped liquid, and a thread-shaped liquid with a tail. As the liquid herein, any material may be used as long as it can be ejected by the recording apparatus. For example, any material in a liquid phase may be used. Examples of the material include liquid materials with high or low viscosity and fluid materials, such as sol, gel water, other inorganic solvents, organic solvents, solutions, liquid resins, and liquid metals (metal melt). In addition, there are included not only liquid as one state of a substance but also a material in which particles of a functional material composed of a solid, such as a pigment or metal particles, are dissolved in, dispersed in or mixed with a solvent. As a typical example of the liquid, ink as described in the embodiment is taken. Examples of ink include various types of liquid composition, such as general water-based ink and oil-based ink, gel ink, and hot melt ink. Furthermore, examples of the recording medium include paper, high performance paper, synthetic paper, substrates, and metal plates, in addition to plastic films, such as polyvinyl chlorides and polyethylene terephthalate films.

What is claimed is:

1. A recording apparatus comprising:

a support member that supports a recording medium;

a heating device that heats the recording medium on the support member;

a recording head that ejects fluid onto the recording medium on the support member and that is positioned between the support member and the heating device;

a blower that has a blowing port from which gas is blown; and a carriage that moves and has the recording head mounted thereon and an enclosing structure inside which at least part of the gas blown from the blowing port is taken and inside which a gas layer in which the gas flows is formed between the recording head and the heating device, wherein the enclosing structure of the carriage has a heat sink plate that has one surface facing the heating device and the other surface facing the gas layer.

2. The recording apparatus according to claim 1, wherein the carriage has an intake port that opens opposite the blowing port.

3. The recording apparatus according to claim 1, further comprising:

a transport device that transports the recording medium, wherein the carriage has an exhaust port that opens downstream in a transport direction of the recording medium.

4. The recording apparatus according to claim 1, wherein the blowing port is provided along a movement path of the carriage.

5. The recording apparatus according to claim 4, wherein the heating device has a heat generating section that is provided along the movement path of the carriage, and, in the movement path of the carriage, a portion covered by the blowing port is larger than a portion covered by the heat generating section.

* * * * *